US011015837B2

(12) United States Patent
Hanks et al.

(10) Patent No.: US 11,015,837 B2
(45) Date of Patent: May 25, 2021

(54) BRACKETS FOR MOUNTING COMPONENTS WITHIN A FURNACE

(71) Applicant: Trane International Inc., Davidson, NC (US)

(72) Inventors: Andrew Hamilton Hanks, Tyler, TX (US); Thomas Gort, Tyler, TX (US); Joshua Brian Coley, Dallas, TX (US)

(73) Assignee: Trane International Inc., Davidson, NC (US)

( * ) Notice: Subject to any disclaimer, the term of this patent is extended or adjusted under 35 U.S.C. 154(b) by 80 days.

(21) Appl. No.: 16/422,024

(22) Filed: May 24, 2019

(65) Prior Publication Data

US 2020/0370787 A1 Nov. 26, 2020

(51) Int. Cl.

| | |
|---|---|
| ***F24H 9/18*** | (2006.01) |
| ***F23C 5/02*** | (2006.01) |
| *F23C 3/00* | (2006.01) |

(52) U.S. Cl.

CPC ..... *F24H 9/1881* (2013.01); *F23C 5/02* (2013.01); *F23C 3/002* (2013.01); *F23C 2900/00* (2013.01)

(58) Field of Classification Search

CPC ..... F16K 35/06; F16K 17/36; F16K 1/126; F16K 1/221; F16K 1/443; F16K 27/003; F16K 27/0263; F16K 27/067; F16K 31/061; F16K 31/122; F16K 37/00; F16K 11/048; F16K 11/0655; F16K 11/0716; F16K 11/087; F16K 17/02; F16K 17/194; F16K 1/307; F16K 1/308; F16K 27/029; F16K 27/041; F16K 31/04; F16K 31/041; F16K 31/055; F16K 31/0668; F16K 31/46; F16K 31/60; F16K 31/602; F16K 37/0083; F16K 5/0242; F16K 5/0407; F16K 5/0442; F16K 5/0647; F16K 5/08; F16K 5/103; F16K 24/044; F16K 31/02; F16K 11/076; F16K 11/083; F16K 11/0856; F16K 15/148; F16K 17/087; F16K 1/34; F16K 21/18; F16K 24/04; F16K 24/042; F16K 27/02; F16K 27/0281; F16K 27/102; F16K 27/12; F16K 31/004; F16K 31/126; F16K 31/22; F16K 31/50; F16K 37/0033; F16K 37/0041; F16K 5/0207; F16K 5/0214; F16K 27/00; F23L 11/005; F23L 13/02; F24C 3/12; F24C 3/126; F02M 61/14; F02M 55/025; F02M 2200/856; F02M 35/10177; F02M 35/10216; F02M 35/1085; F02M 61/06; F02M 61/1806; F02M 61/1853;

(Continued)

(56) References Cited

U.S. PATENT DOCUMENTS

| | | | |
|---|---|---|---|
| 5,380,193 | A | 1/1995 | Williams et al. |
| 2009/0044793 | A1 | 2/2009 | Khan et al. |

(Continued)

*Primary Examiner* — Jason Lau

(74) *Attorney, Agent, or Firm* — Womble Bond Dickinson (US) LLP

(57) ABSTRACT

Embodiments relate generally to mounting components of a furnace. A mounting assembly may include brackets attached to a burner box of the furnace. Each bracket includes an opening configured to receive a gas line, a recess configured to receive a gas supply valve, a pressure transducer aperture configured to receive a pressure transducer, and slots adjacent to the pressure transducer aperture. The slots are configured to secure the pressure transducer to the bracket.

19 Claims, 10 Drawing Sheets

(58) Field of Classification Search
CPC ..... F02M 69/044; F02M 2200/857; F02M 26/32; F02M 5/00; F02M 21/0278; F02M 21/0281; F02M 21/029; F02M 2200/09; F02M 2200/27; F02M 2200/30; F02M 2200/8023; F02M 2200/8053; F02M 2200/852; F02M 2200/9053; F02M 2200/9076; F02M 2547/008; F02M 25/08; F02M 26/12; F02M 26/26; F02M 26/31; F02M 35/161; F02M 37/0023; F02M 37/007; F02M 37/0076; F02M 37/20; F02M 37/32; F02M 43/00; F02M 47/027; F02M 53/04; F02M 53/043; F02M 53/08; F02M 61/12; F02M 61/165; F02M 63/0026; F02M 63/0028; F02M 63/0035; F02M 63/0045; F02M 63/0056; F02M 63/0225; F02M 69/042; F23D 14/70; F23D 14/02; F23D 14/14; F23D 14/34; F23D 17/002; F23D 14/28; F23D 14/38; F23D 2207/00; F24F 13/222; F24F 12/006; F24F 2013/227; F24F 5/0096; F24H 1/205; F24H 9/0026; F24H 9/0031; F24H 9/2035; F24H 9/2007; F24H 8/00; F24H 8/006; F24H 3/087; F24H 9/1881; F23C 5/02; F23C 3/002; F23C 99/006; F23K 5/007; F23N 2225/22; F23N 2235/18; F23N 2235/20; F23N 3/042; F23N 2227/28; F23N 2227/36; F23N 5/12; F23N 1/005; F23N 2235/24; F24D 19/0095; F24D 19/1084; F24D 5/00; F24D 5/02; F24D 2220/04; F25B 9/04
See application file for complete search history.

(56) References Cited

U.S. PATENT DOCUMENTS

| | | | |
|---|---|---|---|
| 2011/0174891 | A1 | 7/2011 | Kowald et al. |
| 2013/0213378 | A1 | 8/2013 | Schultz |
| 2015/0369495 | A1 | 12/2015 | Maricic et al. |
| 2019/0353347 | A1* | 11/2019 | Anwar ..... F24D 19/1084 |
| 2020/0124280 | A1 | 4/2020 | Shaw |

* cited by examiner

BRACKETS FOR MOUNTING COMPONENTS WITHIN A FURNACE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A typical furnace may include a burner system. The burner system may include a burner box, where a fuel, such as natural gas, is delivered and combusted to generate heat. A gas supply valve regulates a flow of gas into the burner box, and a pressure of the burner system can be monitored by a pressure transducer. Preventing damage to the gas supply valve and the pressure transducer is critical in maintaining proper operation of the furnace.

SUMMARY

In an embodiment, a furnace may include heat exchanger tubes, a burner box fluidly coupled to the heat exchanger tubes, and brackets attached to the burner box. Each bracket may include an opening configured to receive a gas line, a recess configured to receive a gas supply valve, a pressure transducer aperture configured to receive a pressure transducer, and slots adjacent to the pressure transducer aperture, wherein the slots are configured to secure the pressure transducer to the bracket.

In an embodiment, a burner sub-system for a gas-fired furnace may include a burner box configured to receive air and fuel in a premixed ratio, the burner box having a front side and a rear side opposite the front side, the rear side configured to emit a flame. The burner sub-system may also include a pair of brackets protruding from the front side of the burner box. Each bracket may include a main wall, the main wall of each bracket is parallel to the main wall of the other bracket, and each main wall is substantially perpendicular to the front side of the burner box. The burner sub-system may also include a gas supply valve retained between the pair of main walls of the pair of brackets. The burner sub system may also include a pressure transducer at least partially passing through an aperture in the main wall of at least one of the pair of brackets.

In an embodiment, a bracket may include an opening configured to receive a gas line, a recess configured to receive a gas supply valve, a pressure transducer aperture configured to receive a pressure transducer, and slots adjacent to the pressure transducer aperture, wherein the slots are configured to secure the pressure transducer to the bracket.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
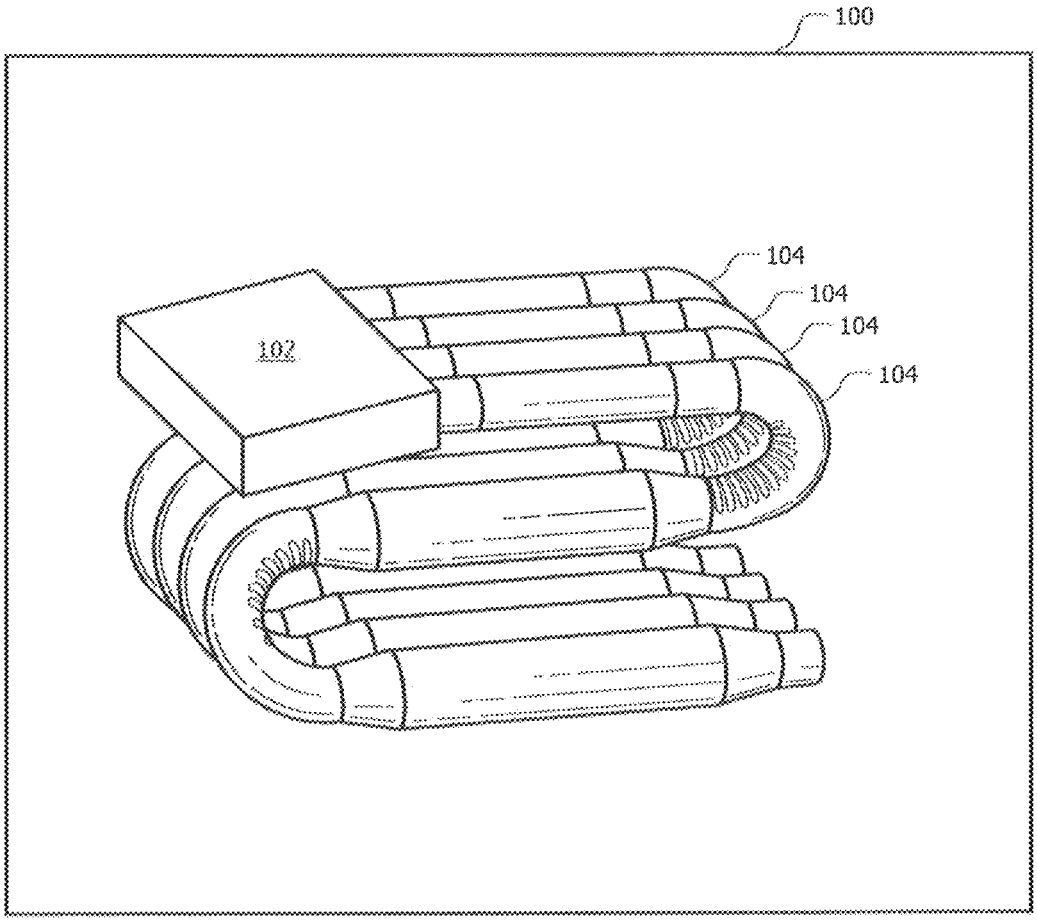
FIG. 1 is a side view of a furnace in accordance with an embodiment of the disclosure.

A typical burner system of a furnace, such as, a premixed burner system, for example, may include a gas line, a gas supply valve, a pressure transducer/switch, a conduit, and a burner box. During installation/servicing of the premixed burner system, a gas line is attached to the gas supply valve. During attachment, over-torquing of the gas line to the gas supply valve may occur by a technician using a pipe wrench. For example, more than 80 pounds (lbs) of force may be applied during attachment. Additionally, accidentally striking or moving the gas supply valve can similarly impart 80 lbs or more of force to the gas supply valve.

Further, a pressure transducer is utilized to monitor pressure created by a draft inducer of a furnace during furnace start-up, and to shut down furnace ignition if the pressure is inadequate. The pressure transducer of the premixed burner system may be made of plastic, and thus cannot be mounted to hot surfaces because of the risk of melting or other damage to the plastic.

The present disclosure relates generally to brackets that are attached to a burner box of a premixed burner system. The brackets create a robust mounting platform for various components of the premixed burner system, such as, for example, the gas line, the gas supply valve, the pressure transducer, and a J-tube conduit. Specifically, the brackets are configured to receive the gas line, the gas supply valve, the pressure transducer, and the J-tube conduit. The brackets provide force and torque resistance that protect the gas supply valve and the pressure transducer from damage.

Further, the brackets prevent overheating of the pressure transducer, because the pressure transducer, when mounted to one of the brackets, is not in direct contact with the burner box and is positioned away, for example one inch or more from the burner box. Additionally, while the brackets include multiple component mounting features, the brackets are configured so as to simplify the manufacturing process by reducing the total number of components needed for the premixed burner system. The reduction of components reduces manufacturing costs.

The brackets may be designed to be permanently attached to the burner box. For example, the brackets may be welded to the burner box. Alternatively, the burner box may include welded sub-brackets that the brackets are screwed into. This allows the brackets to be removable from the sub-brackets. A smaller secondary bracket may attach to one of the brackets, and is configured to receive a portion of the gas supply valve. The secondary bracket assists in stabilizing the gas supply valve in the brackets. The secondary bracket is configured to prevent movement of the gas supply valve while it is mounted to the brackets.

Further, the brackets include several recesses/indentations, apertures, openings, and/or slots at various locations of the brackets. For example, the brackets may include a hole or opening that allows a U-bend gas line to pass through the brackets. The brackets may also include a recess to allow mounting of a gas supply valve. The brackets may further include a transducer aperture to allow mounting of a pressure transducer. The brackets may also include slots to allow for passage of zip ties or other types of lines or wires, to allow securing of the pressure transducer to the brackets. In some embodiments, the slots may be configured to receive clips, such as resilient clips, to attach the pressure transducer. For example, the lines may pass through or around a portion of the pressure transducer and pass through the slots. Alternatively, the brackets may include openings to receive screws for attaching the pressure transducer to the brackets. The recesses, apertures, and/or slots are positioned to provide secure mounting positions for the various components and allow a sufficient amount of space between the components for installation, removal, and/or servicing. The brackets may be formed from metal or a metal alloy by metal-working techniques known in the art, such as for example, stamping, forging, machining, or casting.

Additionally, the present disclosure relates to the J-tube conduit. Typically, a premixed burner system includes a gas supply valve, a pressure transducer, a conduit, and a burner box. The conduit connects the gas supply valve to the burner box. The conduit is typically made of iron pipe that is quite bulky. The iron pipe conduit threads directly into the gas supply valve using pipe threads. However, an iron pipe conduit is not easy to remove in the field. Iron pipe conduits are bulky and occupy a considerable amount of space. Also, due to the large pipe diameter (outer diameter, OD) of the iron pipe conduit, bend radii may be large, creating further space issues, for example, especially in narrow furnace cabinets where total widths can range from as little as 13 inches to 15 inches. If the iron pipe conduit needs to be removed, such as for servicing of the premixed burner system, then the gas supply valve and/or the pressure transducer may also need to be removed. Such removal may be time consuming and inconvenient for a service technician.

The J-tube conduit of the present disclosure includes a smaller diameter conduit tube that can easily be installed and removed in the field, without removing the gas supply valve and/or pressure transducer. The J-tube conduit is so called because it may be shaped similar to the letter "J" to allow a fluid connection from the gas supply valve to the burner box. The J-tube conduit may include a first portion and a second portion.

The first portion of J-tube conduit is removably coupled to a spud (gas spud) or spud orifice fitted into a fluid/gas output port of the gas supply valve. A flare nut of the J-tube conduit tightens to connect an end of the first portion of the J-tube conduit to the spud or is loosened to disconnect the end of the first portion from the spud. A commonly used spud or spud orifice is sufficient for this purpose.

The second portion of the J-tube conduit may be removably coupled to the burner box via a slip fit. An end of the second portion may be inserted into a gas inlet of the burner box without any further attachment besides insertion. An o-ring may also be positioned on the end of the second portion to assist with providing a seal with the gas inlet of the burner box. An outer diameter of the J-tube conduit may be greater than 0.2 inch and less than 0.84 of an inch, for example around 0.5 inch. The smaller diameter of the J-tube allows for positioning of the J-tube conduit into the narrow furnace cabinets due to smaller bend radii of a second portion of the J-tube conduit, as compared to a typical iron pipe conduit which may have a diameter of 0.84 inch. The bend radii may range from 0.100 inches to 2 inches from a center line. Further, the smaller J-tube conduit is formed using less material, as compared to a typical iron pipe conduit, resulting in a lower production cost.

Referring to FIG. 1, a side view of an exemplary furnace 100 is shown. Furnace 100 may include burner box 102 fluidly coupled to heat exchanger tubes 104. Burner box 102 receives and combusts a premixed mixture of air and fuel, thereby distributing heat through heat exchanger tubes 104. A gas supply valve may supply burner box 102 with the fuel.

Figure 2:
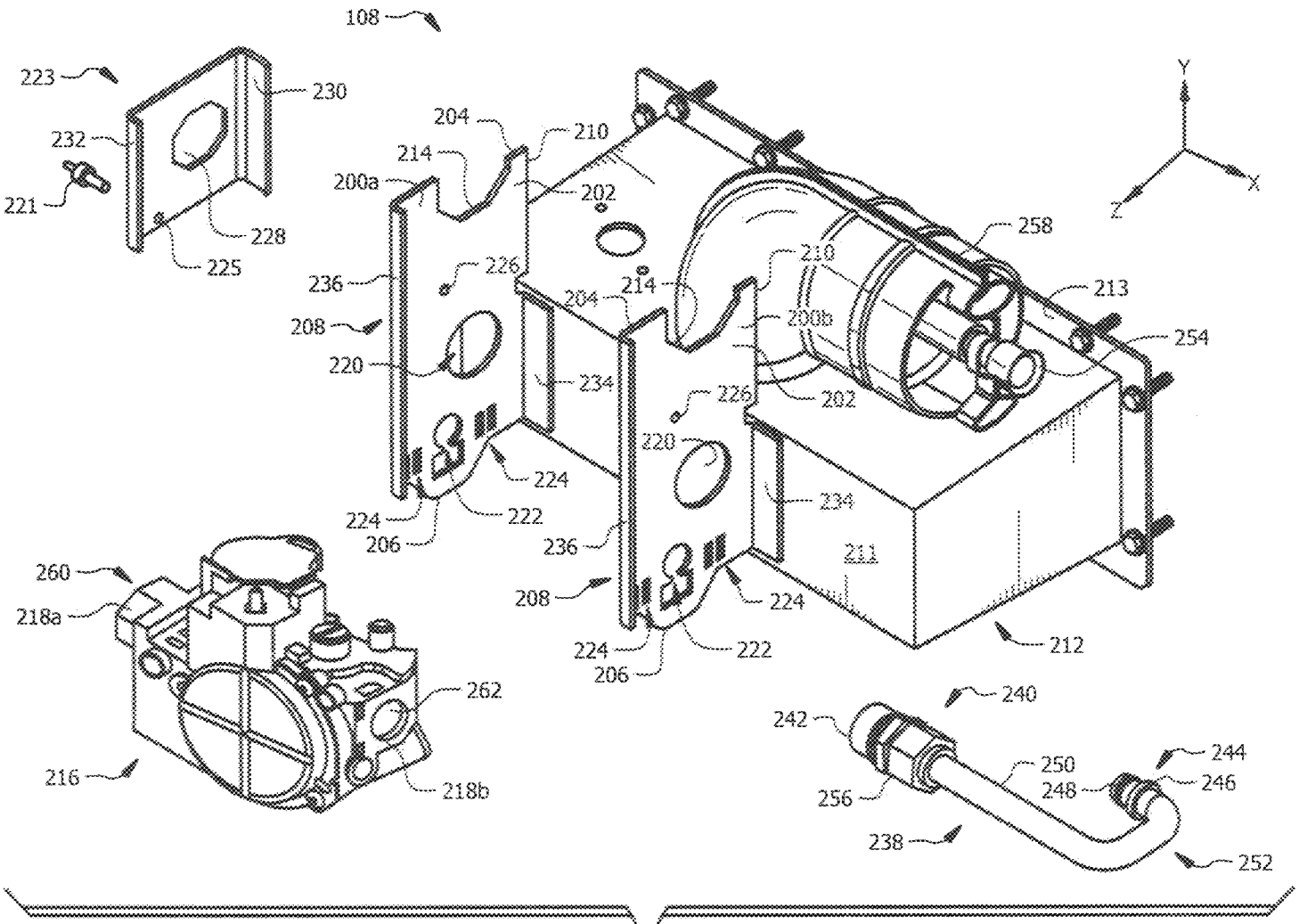
FIG. 2 illustrates components of a mounting assembly, in accordance with an embodiment of the disclosure.

FIG. 2 illustrates a burner sub-system 108 including burner box 212 fitted with brackets 200*a* and 200*b* as contemplated according to one embodiment of the present disclosure. Burner box 212 is screwed into a vest panel of a heat exchanger assembly. Brackets 200*a* and 200*b* are not utilized for mounting burner box 212 within a furnace. Brackets 200*a* and 200*b* may each include planar wall 202 (e.g., a main wall) extending between: (1) first edge 204 and second edge 206, and (2) first end 208 and second end 210. First end 208 and second end 210, may each include, for example, a bent portion for stiffness and strength. First edge 204 and second edge 206 extend between first end 208 and second end 210. First edge 204 is positioned opposite to second edge 206, as shown. First end 208 is positioned opposite to second end 210, as shown. Second end 210 is attached to burner box 212 via welding, for example. Burner box 212 is a particular implementation of burner box 102. Burner box 212 may function similarly to burner box 102 and also may be fluidly coupled to heat exchanger tubes 104, similarly to that of burner box 102, as shown on FIG. 1. Burner box 212 is configured to receive a premixed air-fuel mixture, combust the premixed air-fuel mixture, and supply heat to heat exchanger tubes. Burner box 212 includes front side 211 and rear side 213 opposite to front side 211. Rear side 213 is configured to emit a flame. Brackets 200*a* and 200*b* can be attached to other types of burner boxes/premixed burners for furnaces, as will be understood by one skilled in the art. As mentioned, brackets 200*a* and 200*b* may be made, for example, of aluminum, steel, or an alloy, and formed by stamping, forging, machining, or casting, for example.

Figure 4:
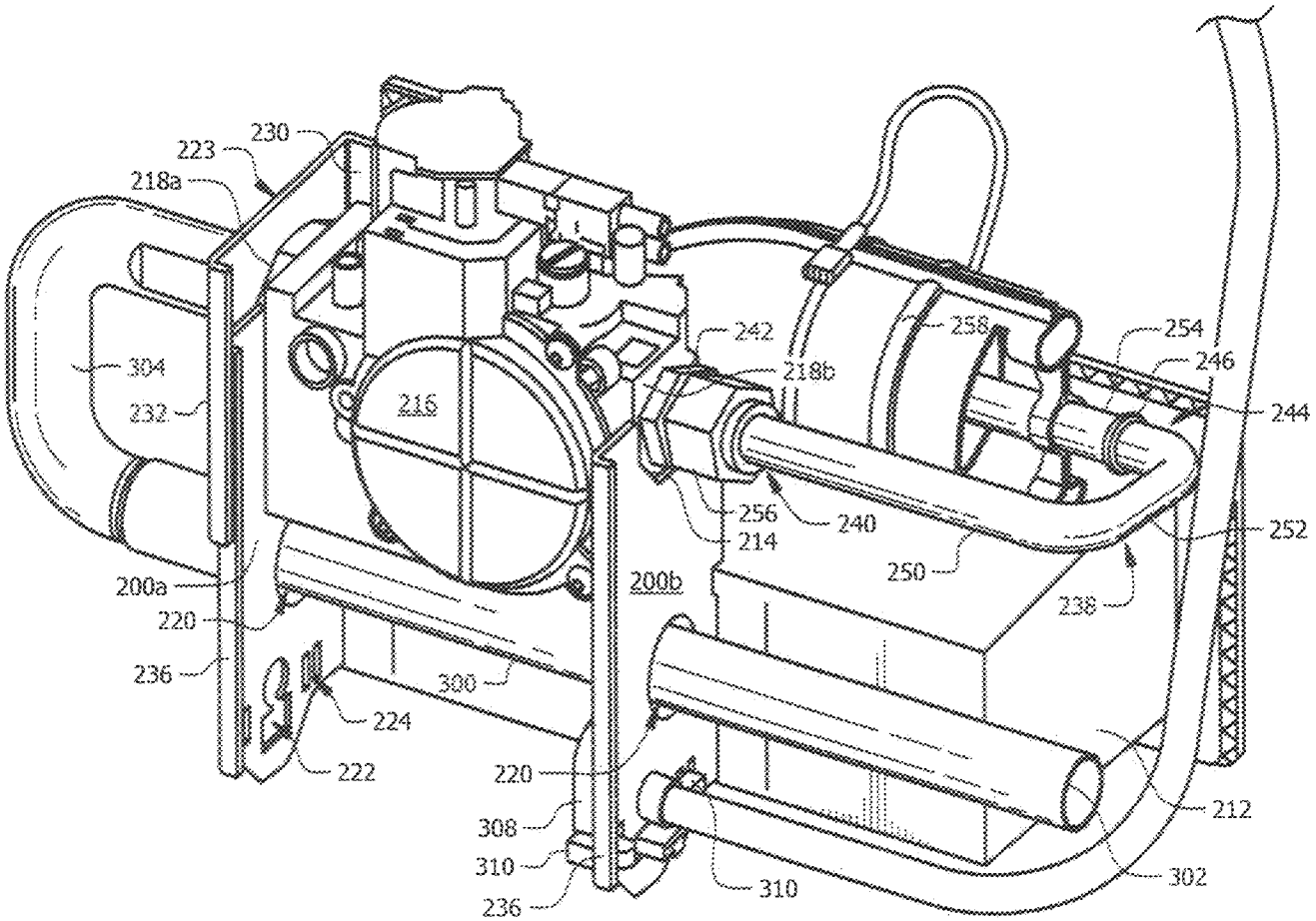
FIG. 4 is a front perspective view of a mounting assembly with a gas line passing through brackets, in accordance with an embodiment of the disclosure.

First edge 204 may include recess 214, as shown. Recess 214 is configured to receive gas supply valve 216. Gas supply valve 216 is a typical gas supply valve configured to supply gas to burner box 212 as will be readily understood by one skilled in the art. Gas supply valve 216 may rest upon or between recesses 214 as shown in FIG. 4. The shape of recess 214 may correspond with the shape of portions 218*a* and/or 218*b* of gas supply valve 216. For example, recess 214 may be shaped to receive octagon-shaped portions 218*a* and/or 218*b* of gas supply valve 216 or coupling portions thereof. Recesses 214 may include five sides of an octagon, as shown that correspond to the octagon-shaped portions 218*a* and 218*b* of gas supply valve 216 or coupling portions thereof, and allow for a snug fit between recesses 214 and gas supply valve 216, and may prevent movement of gas supply valve 216 while mounted to recesses 214.

In addition, brackets 200*a* and 200*b* may each include gas line opening 220 positioned toward a center of brackets 200*a* and 200*b*. A gas line may be placed or passed through gas line openings 220. The various configurations of the gas line and brackets 200*a* and 200*b* are shown, for example, on FIGS. 4-6.

Brackets 200*a* and 200*b* may each also include transducer apertures 222 positioned adjacent to second edge 206. Transducer aperture 222 is configured to receive a pressure transducer (shown on FIGS. 4-6). The pressure transducer may be mounted to either bracket 200*a* or bracket 200*b* via transducer aperture 222. A pressure transducer/switch for furnaces may be made of plastic and is configured to prevent operation of the furnace if correct venting air pressures are not detected, as will be readily understood by one skilled in the art.

Brackets 200*a* and 200*b* may each also include slots 224, which may be positioned adjacent to transducer aperture 222, as shown. Zip ties, wires, or lines may be passed through the slots 224 to secure the pressure transducer to bracket 200*a* or bracket 200*b*. The pressure transducer may be positioned away from burner box 212 by one or more inches to prevent overheating of the pressure transducer.

In addition, brackets 200*a* and 200*b* may each include an engagement opening 226 for attachment of secondary bracket 223. Secondary bracket 223 may include secondary bracket opening 225 and may be attached to either bracket 200*a* or 200*b* via engagement opening 226 and secondary bracket opening 225. Screw 221 may be positioned through engagement opening 226 and secondary bracket opening 225 to attach secondary bracket 223 to bracket 200*a* or bracket 200*b*.

Secondary bracket 223 may include a planar wall made of metal such as for example, aluminum, steel, or an alloy. Secondary bracket 223 may overlap a portion of bracket 200*a* or bracket 200*b*, when attached. Secondary bracket 223 may include opening 228 to receive portion 218*a* or portion 218*b* of gas supply valve 216. The shape of opening 228 corresponds to the shapes of portion 218*a* and/or portion 218*b* and recesses 214, to secure gas supply valve 216 to bracket 200*a* or bracket 200*b*. After gas supply valve 216 has been mounted on recesses 214, secondary bracket 223 may receive portion 218*a* or portion 218*b* via opening 228, then secondary bracket 223 may be attached to bracket 200*a* or bracket 200*b*, as described above. Secondary bracket 223 may also include lip 230 that extends orthogonally from the planar wall of secondary bracket 223, as shown. Lip 230 may extend toward gas supply valve 216 when secondary bracket 223 is attached to bracket 200*a* or bracket 200*b*. Lip 230 is configured to protect gas supply valve 216 as well as provide stiffness, for strength, for secondary bracket 223. Lip 230 also prevents rotation of secondary bracket 223 while secondary bracket 223 is attached to bracket 200*a* or bracket 200*b*. Lip 230 may prevent rotation in a direction parallel to bracket 200*a* or bracket 200*b*, for example, parallel to a yz plane, as shown. On a side opposite to lip 230, secondary bracket 223 includes bend 232 that also provides stiffness and strength to secondary bracket 223 and prevents rotation of secondary bracket 223 while secondary bracket 223 is attached to bracket 200*a* or bracket 200*b*.

Brackets 200*a* and 200*b* may each also include tab 234 for attachment to burner box 212. Tab 234 may extend from each bracket, at an angle ranging from 30° through 90°. Tab 234 allows for secure attachment, such as by welding, of brackets 200*a* and 200*b* to burner box 212. Brackets 200*a* and 200*b*, particularly planar surfaces 202, may, for example, be parallel to each other. Brackets 200*a* and 200*b* may attach to front side 211 of burner box 212 substantially perpendicular to front side 211. On a side opposite to tab 234, brackets 200*a* and 200*b* may include bent portion 236 for providing stiffness and strength to the brackets.

Figure 3:
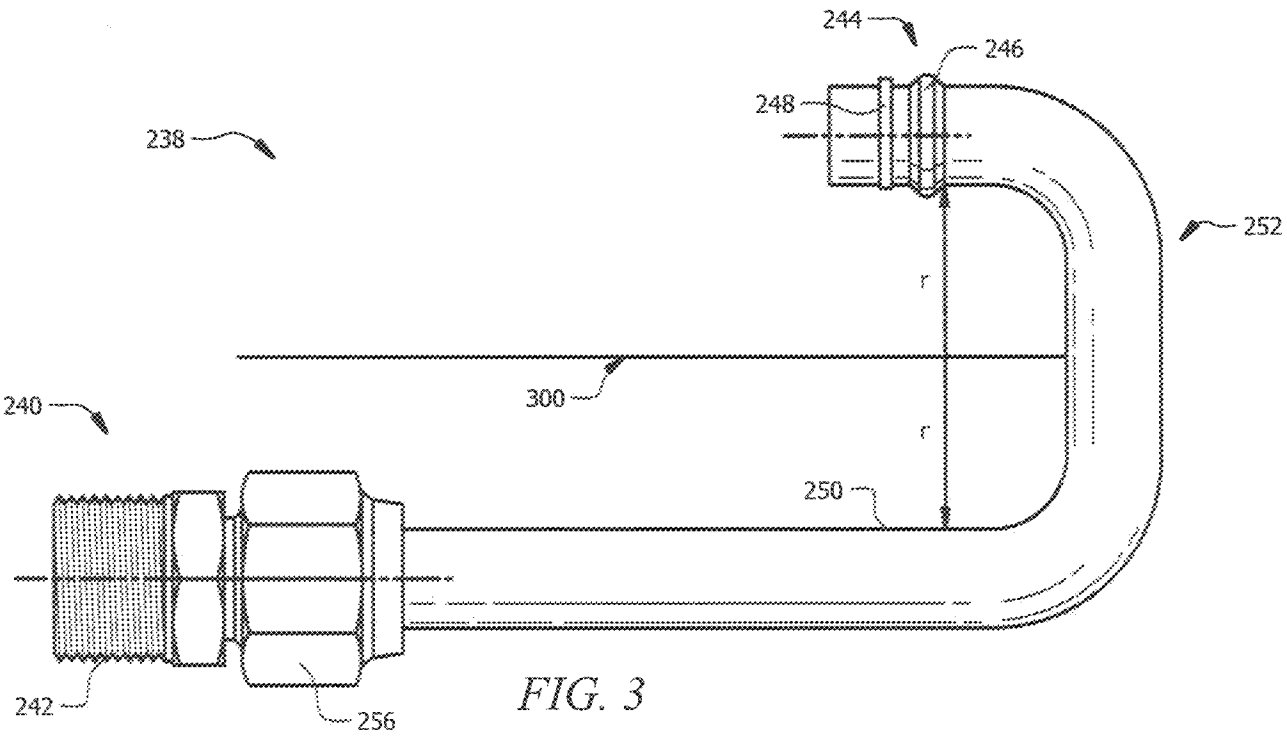
FIG. 3 illustrates a J-tube conduit, in accordance with an embodiment of the disclosure.

With reference to FIGS. 2 and 3, J-tube conduit 238 may include a first end 240 including spud 242, and a second end 244 including a flared portion 246 (e.g., a raised form to assist with sealing J-tube conduit 238 with gas input port 254) and o-ring 248. First end 240 and second end 244 are straight portions of J-tube conduit 238. First end 240 may be parallel to second end 244. Flared portion 246 is configured to connect second end 244 to gas input port 254 of burner box 212. O-ring 248 is also configured to promote a gas-tight seal of second end 244 to gas input port 254 of burner box 212. Flared portion 246 with o-ring 248 may be positioned or inserted into gas input port 254 of burner box 212. An outer diameter of J-tube conduit 238 may be greater than 0.20 inch and less than 0.84 inch. For example, the outer diameter may be about 0.5 inch. J-tube conduit 238 may also include first portion 250 and second portion 252, as shown. The smaller outer diameter of J-tube conduit 238 allows for J-tube conduit 238 to fit into narrow furnace cabinets having widths ranging from 13 inches to 15 inches, such as for example, 14.5 inches. The smaller outer diameter corresponds to smaller bend radii (or distance) between first portion 250 and second portion 252, as compared to a typical iron pipe conduit that has an outer diameter of about 0.84 inch. J-tube conduit 238 may be made of plastic or metal, such as for example, aluminum, steel, iron, or an alloy. The bend radii, r, may range from 0.100 inches to 2 inches from center line 300, as shown on FIG. 3. Center line 300 is positioned between first end 240 and second end 244 and extends in a direction that is parallel to first end 240 and second end 244. For example, the bend radii may be 0.630 inch. The length of first portion 250 may range from 1 inch to 10 inches. The length of second portion 252 may range from 1 inch to 6 inches. In certain embodiments, second portion 252 may curve or bend to position second end 244 parallel to first end 240. The bend radii allow J-tube conduit 238 to fit into narrow furnace cabinets having widths ranging from 13 inches to 15 inches, such as for example, 14.5 inches. J-tube conduit 238 may fluidly connect to gas input port 254 of burner box 212 and gas supply valve 216. Gas input port 254 may be positioned within a venturi tube 258 of burner box 212. Venturi tubes may be utilized for mixing air and fuel for combustion in a furnace, as will be understood by one skilled in the art.

Spud 242 may be coupled via a threaded connection in gas outlet 262 to gas supply valve 216 and may extend from gas outlet 262. Portion 218*b* may include gas outlet 262 and portion 218*a* may include gas inlet 260. First portion 250 may extend through flare nut 256. Flare nut 256 may be configured to tighten to connect first portion 250 to spud 242 or loosen to disconnect first portion 250 from spud 242. It should be noted that other attachment mechanisms, besides a flare nut, may be utilized to secure (or release) first portion to (or from) spud 242. First portion 250 may be removably coupled to spud 242 while spud 242 is threaded into gas outlet 262 of gas supply valve 216. When decoupled, spud 242 remains within gas outlet 262, while first portion 250 is detached from spud 242.

Figure 5:
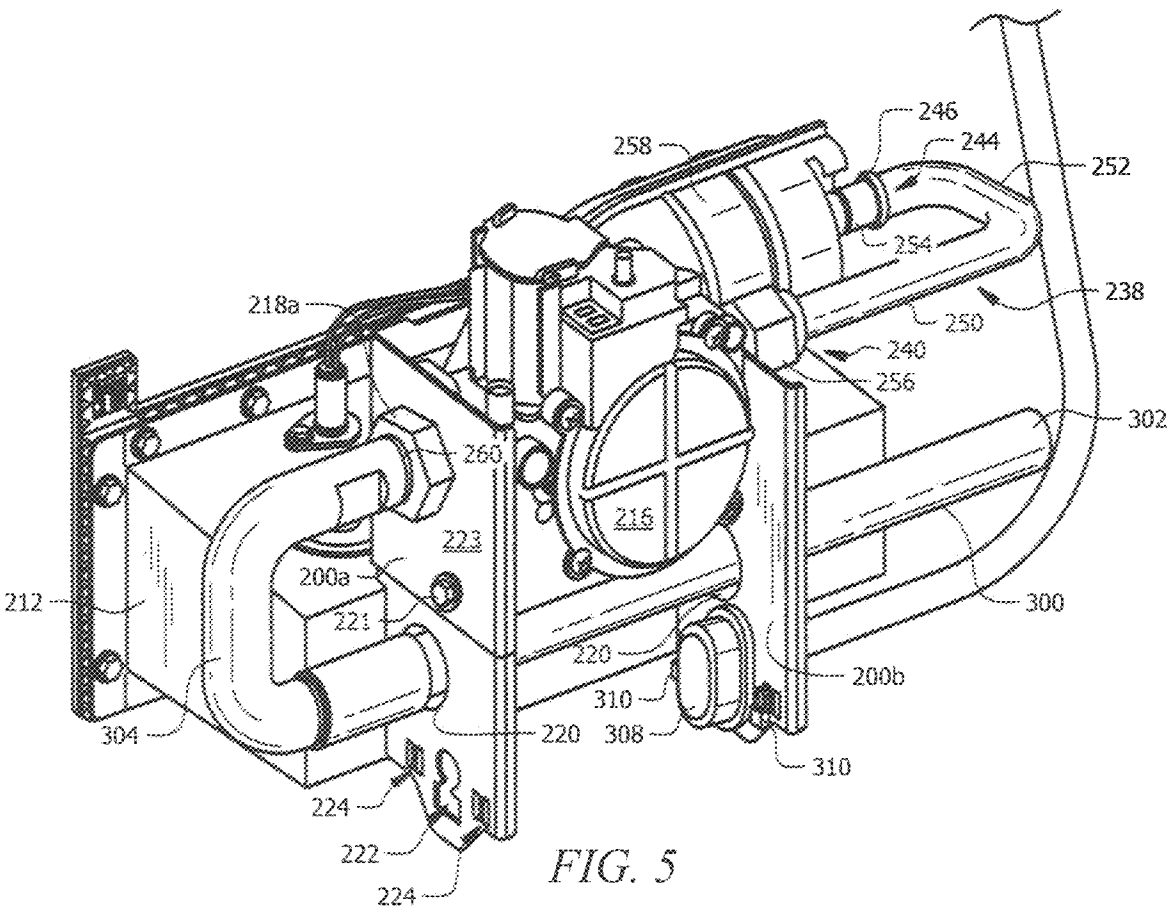
FIG. 5 is another front perspective view of a mounting assembly with a gas line passing through brackets, in accordance with an embodiment of the disclosure.

FIGS. 4 and 5 illustrate gas line 300 positioned, passed through gas line openings 220 and fluidly coupled to gas inlet 260 of gas supply valve 216. End 302 of gas line 300 may be coupled to a gas source. Gas line 300 also includes U-bend portion 304 that terminates for coupling to gas inlet 260 of gas supply valve 216. Gas line openings 220 allow passage of gas line 300 through bracket 200*a* and bracket 200*b* to fluidly connect to gas inlet 260 of gas supply valve 216. Also, pressure transducer 308 is positioned in transducer aperture 222 of bracket 200*b*, as shown. Lines 310, such as zip ties, thread, or wires are inserted through slots 224 of bracket 200*b* and portions of pressure transducer 308, and tightened to secure pressure transducer 308 to bracket 200*b*, as shown. Pressure transducer 308 may at least partially pass through transducer aperture 222 of at least one of the pair of brackets 200*a* and 200*b*. Pressure transducer 308 is connected to a hot header panel by a pressure tube made of silicon. When pressure within a furnace changes due to an inducer ramping up or down, the pressure is sensed through the hot header, through the pressure tube, and into pressure transducer 308. A signal from pressure transducer 308 is then sent to a control board where it is interpreted to adjust operation of the furnace.

Additionally, secondary bracket 223 is attached to bracket 200*a*, as shown. Portions 218*a* and 218*b* of gas supply valve 216 are resting or positioned upon recesses 214 of bracket 200*a* and bracket 200*b*. Opening 228 of secondary bracket 223 receives portion 218*a* of gas supply valve 216 and completely encompasses portion 218*a*, thereby securing gas supply valve 216 to secondary bracket 223 and bracket 200*a*. Flare nut 256 is tightened to spud 242, thereby securing first portion 250 of J-tube conduit 238 to gas supply valve 216. Second end 244 of J-tube conduit 238 is inserted into gas input port 254 via a slip fit.

Figure 6:
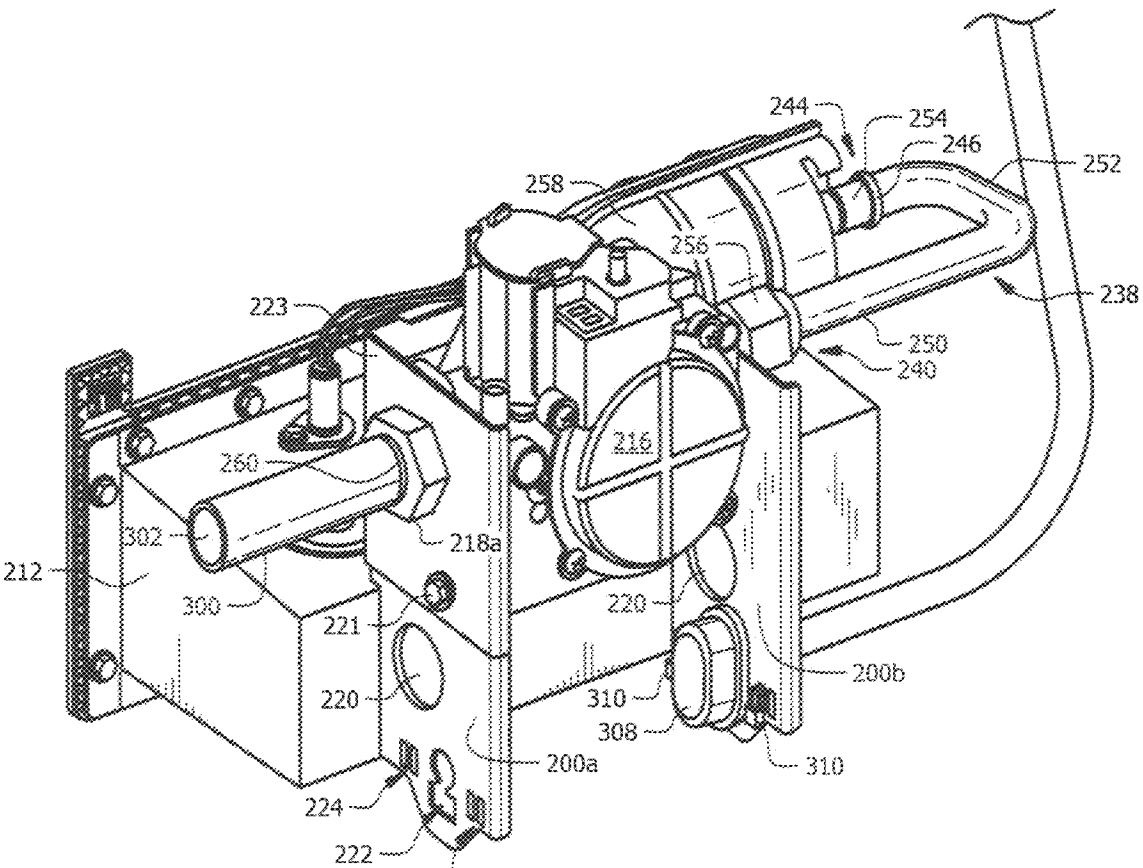
FIG. 6 is another front perspective view of a mounting assembly with a gas line connected directly to a gas supply valve, without passing through brackets, in accordance with an embodiment of the disclosure.

FIG. 6 illustrates an alternate position of a gas line 300, as compared to the configuration shown in FIGS. 4 and 5. As shown, gas line 300 originates from the left of bracket 200*a* and bracket 200*b*, and is directly connected to portion 218*a* of gas supply valve 216. Therefore, gas line 300 does not pass through gas line openings 220, and U-bend portion 304 is not needed, nor utilized to connect gas line 300 to portion 218*a* of gas supply valve 216. As shown, gas line openings 220 may not be utilized in this configuration.

Figure 7:
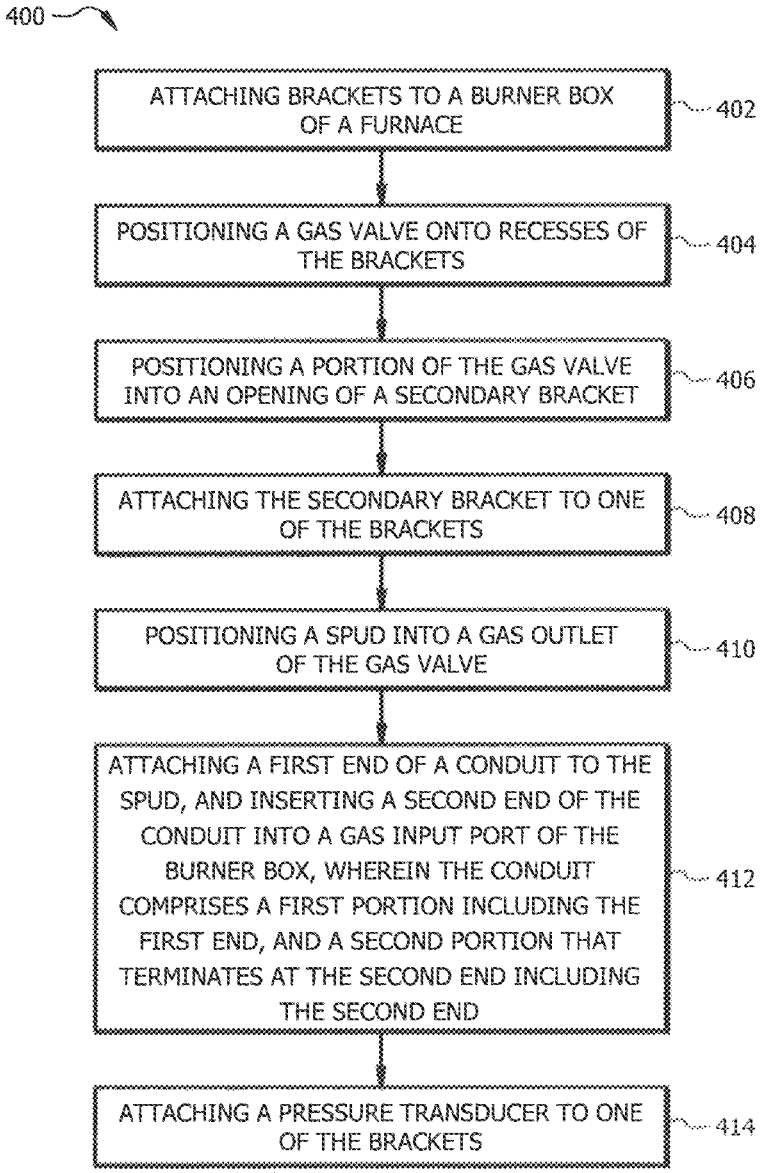
FIG. 7 is a flow chart illustrating steps of mounting components of a furnace, in accordance with an embodiment of the disclosure.

FIG. 7 is a flow chart 400 illustrating steps of mounting components of a premixed burner assembly. Step 402 includes attaching brackets 200*a* and 200*b* to burner box 212 of a furnace 100. Step 404 includes positioning gas supply valve 216 onto recesses 214 of bracket 200*a* and bracket 200*b*. Step 406 includes positioning portion 218*a* or portion 218*b* of gas supply valve 216 into opening 228 of secondary bracket 223.

Step 408 includes attaching secondary bracket 223 to bracket 200*a* or bracket 200*b*. Step 410 includes positioning spud 242 into gas outlet 262 of gas supply valve 216. Step 412 includes attaching first end 240 of J-tube conduit 238 to spud 242 and inserting second end 244 of J-tube conduit 238 into gas input port 254 of burner box 212, wherein J-tube conduit 238 comprises first portion 250 including first end 240, and second portion 252 that terminates at second end 244. Step 414 includes attaching pressure transducer 308 to bracket 200*a* or bracket 200*b*.

In certain embodiments, brackets 200*a* and 200*b* may be attached to burner box 212 before burner box 212 is installed in a furnace. Also, secondary bracket 223 along with components to be mounted (e.g., gas supply valve 216, J-tube conduit 238, pressure transducer 308) may be mounted to brackets 200*a* and 200*b* before burner box 212 is installed within the furnace.

In other embodiments, brackets 200*a* and 200*b* may be attached to burner box 212 before burner box 212 is installed in the furnace, however, secondary bracket 223 and the components to be mounted may be mounted to brackets 200*a* and 200*b* after burner box 212 is installed within the furnace.

Figure 8:
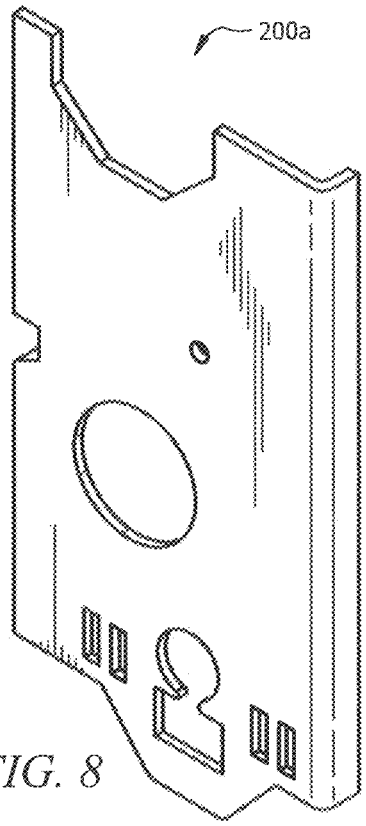
FIG. 8 is a left side perspective view of a bracket in accordance with an embodiment of the disclosure.

FIG. 8 is a perspective view of bracket 200*a* (or 200*b*), as described herein.

Figure 9:
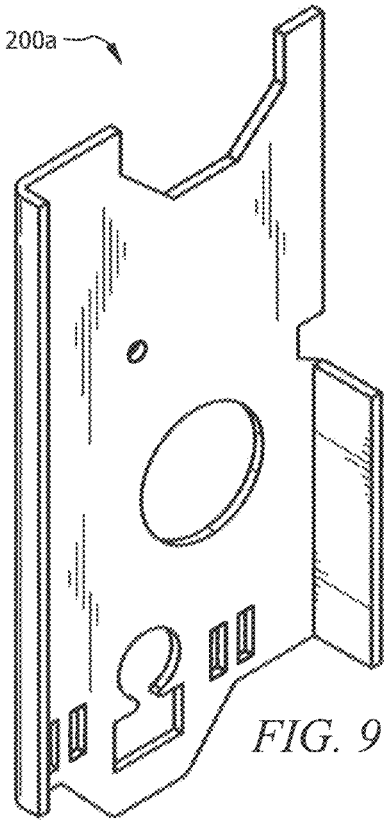
FIG. 9 is a right side perspective view thereof.

FIG. 9 is a side elevation view of bracket 200*a* (or 200*b*), as described herein.

Figure 10:
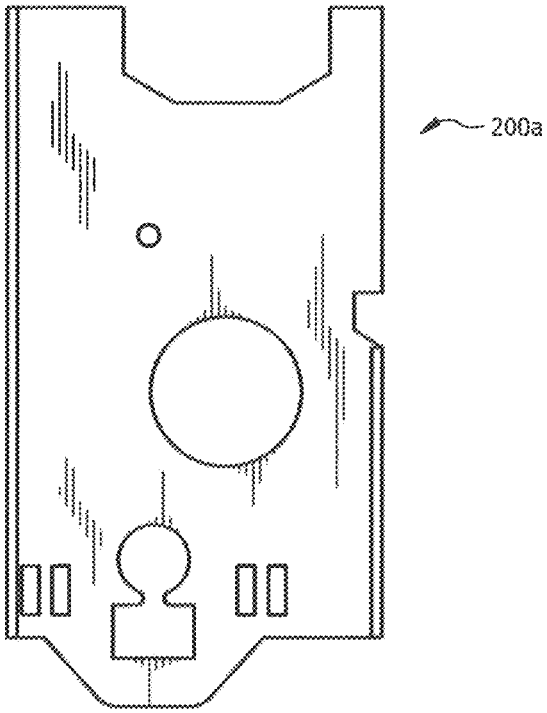
FIG. 10 is a right side elevation view thereof.

FIG. 10 is an opposite side elevation view of bracket 200*a* (or 200*b*), as described herein.

Figure 11:
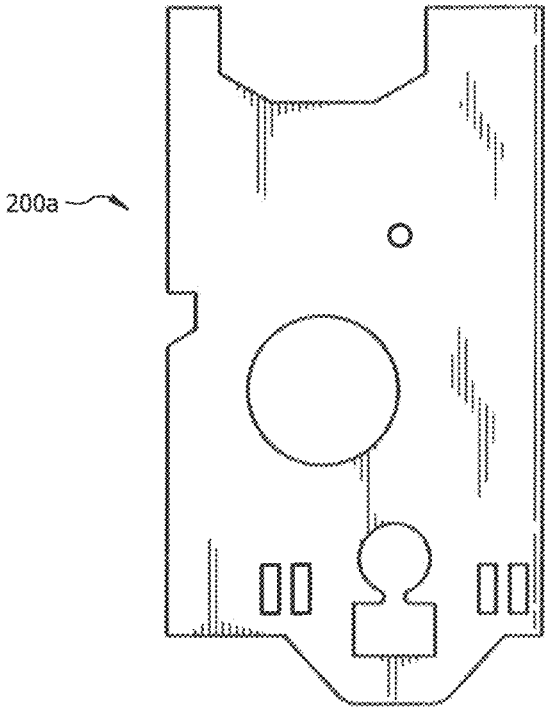
FIG. 11 is a left side elevation view thereof.

FIG. 11 is a front elevation view of bracket 200*a* (or 200*b*), as described herein.

Figure 12:
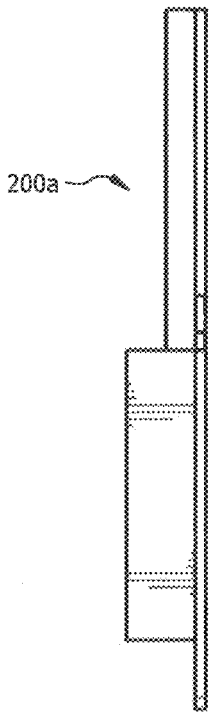
FIG. 12 is a rear elevation view thereof.

FIG. 12 is a rear elevation view of bracket 200*a* (or 200*b*), as described herein.

Figure 13:
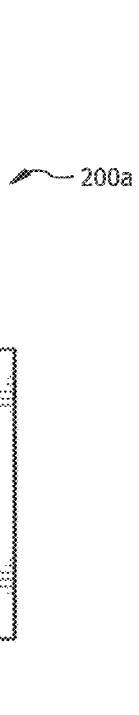
FIG. 13 is a front elevation view thereof.

FIG. 13 is a top plan view of bracket 200*a* (or 200*b*), as described herein.

Figure 14:
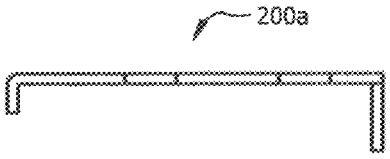
FIG. 14 is a top plan view thereof.
Figure 15:
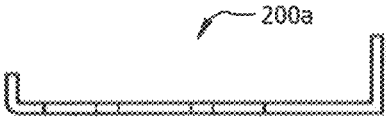
FIG. 15 is a bottom plan view thereof.

FIG. 14 is a bottom plan view of bracket 200*a* (or 200*b*), as described herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, Ru, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A furnace comprising:

heat exchanger tubes;

a burner box fluidly coupled to the heat exchanger tubes;
a gas supply valve; and
a bracket attached to the burner box for mounting the gas supply valve within the furnace, wherein the bracket further comprises a pressure transducer aperture configured to receive a pressure transducer.

2. The furnace of claim 1, further comprising a secondary bracket attached to the bracket, wherein an opening of the secondary bracket is configured to receive a portion of the gas supply valve.

3. The furnace of claim 2, wherein the bracket comprises a recess configured to receive the gas supply valve.

4. The furnace of claim 1, wherein the bracket further comprises slots adjacent to the pressure transducer aperture, wherein the slots are configured to secure the pressure transducer to the bracket.

5. The furnace of claim 4, wherein the bracket further comprises an opening configured to receive a gas line.

6. The furnace of claim 5, wherein the opening of the secondary bracket includes a shape similar to at least a portion of a shape of the recess.

7. The furnace of claim 6, wherein the recess is positioned on a first edge of the bracket.

8. The furnace of claim 7, wherein the pressure transducer aperture and the slots are adjacent to a second edge of the bracket, wherein the second edge is positioned opposite to the first edge.

9. The furnace of claim 8, wherein the opening of the bracket is positioned between the first edge and the second edge.

10. The furnace of claim 9, wherein the bracket includes a planar wall extending from the first edge to the second edge.

11. The furnace of claim 1, further comprising:
a gas input port into the burner box; and
a conduit including:
a first portion; and
a second portion, wherein a bend radii between the first portion and the second portion ranges from 0.100 inches to 2 inches;
wherein an end of the second portion is configured to insert into the gas input port of the burner box.

12. The furnace of claim 11, wherein the second portion includes a flared portion or raised form to seal with the gas input port of the burner box.

13. The furnace of claim 12, wherein a diameter of the conduit is less than 0.84 inch.

14. The furnace of claim 13, wherein the first portion includes a flare nut, wherein an end of the first portion is configured to attach to a spud extending from the gas supply valve, via the flare nut, wherein the first portion extends through the flare nut.

15. The furnace of claim 14, wherein the second portion further includes an o-ring to seal with the gas input port of the burner box.

16. A burner subsystem for a gas-fired furnace, comprising:
a burner box configured to receive air and fuel in a premixed ratio, the burner box having a front side and a rear side opposite the front side, the rear side configured to emit a flame;
a pair of brackets protruding from the front side of the burner box, each bracket comprising a main wall, the main wall of each bracket is parallel to the main wall of the other bracket, and each main wall is perpendicular to the front side of the burner box;
a gas supply valve retained between the pair of main walls of the pair of brackets; and
a pressure transducer at least partially passing through an aperture in the main wall of at least one of the pair of brackets.

17. The burner sub-system of claim 16, further comprising a secondary bracket attached to one of the brackets, wherein an opening of the secondary bracket is configured to receive a portion of the gas supply valve.

18. The burner sub-system of claim 17, wherein each bracket comprises a recess configured to receive the gas supply valve.

19. The burner sub-system of claim 18, wherein each bracket further comprises slots adjacent to the aperture, wherein the slots are configured to secure the pressure transducer to the bracket.

* * * * *